US008295747B2

(12) United States Patent
Sakka et al.

(10) Patent No.: US 8,295,747 B2
(45) Date of Patent: Oct. 23, 2012

(54) INTERMEDIATE TRANSFER MEMBER FOR USE IN ELECTROPHOTOGRAPHIC IMAGE FORMING APPARATUS

(75) Inventors: Kenji Sakka, Hino (JP); Yuichiro Maehara, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 342 days.

(21) Appl. No.: 12/600,994

(22) PCT Filed: May 23, 2008

(86) PCT No.: PCT/JP2008/059555

§ 371 (c)(1),
(2), (4) Date: Nov. 19, 2009

(87) PCT Pub. No.: WO2008/146743

PCT Pub. Date: Dec. 4, 2008

(65) Prior Publication Data

US 2010/0158583 A1 Jun. 24, 2010

(30) Foreign Application Priority Data

May 25, 2007 (JP) ..... 2007-138893

(51) Int. Cl.
*G03G 15/01* (2006.01)

(52) U.S. Cl. ..... 399/302

(58) Field of Classification Search ..... 399/302, 399/303, 308

See application file for complete search history.

(56) References Cited

U.S. PATENT DOCUMENTS 6,101,360 A * 8/2000 Hara et al. ..... 399/308

FOREIGN PATENT DOCUMENTS

| | | | |
|---|---|---|---|
| JP | 2000-206801 | A | 7/2000 |
| JP | 2003-165857 | A | 6/2003 |
| JP | 2005-309182 | A | 11/2005 |
| JP | 2006-259581 | A | 9/2006 |
| WO | 2007/046218 | A1 | 4/2007 |

OTHER PUBLICATIONS

International Search Report for International Application No. PCT/JP2008/059555 mailed Jul. 22, 2008 with English translation.

* cited by examiner

*Primary Examiner* — Hoang Ngo
(74) *Attorney, Agent, or Firm* — Cantor Colburn LLP

(57) ABSTRACT

An intermediate transfer member is provided which enables to maintain superior secondary transferability and enhanced cleaning capability and is also capable of continuing to obtain toner images of superior text reproduction and high quality without causing lack of text images even when making prints of a large number of sheets (e.g., 160,000 sheets). The intermediate transfer member for use in an image forming apparatus having a device capable of transferring a toner image carried on the surface of an electrophotographic photoreceptor primarily to an intermediate transfer member, and secondarily transferring the toner image from the intermediate transfer member to a transfer material, wherein the intermediate transfer member is provided with an elastic layer on the circumference of a resin substrate and further thereon a surface layer, the surface layer exhibits a layer thickness of 10 to 500 nm, the Young's modulus of the surface of the intermediate transfer member which is determined by a nanoindentation method is 0.1 to 5.0 GPa and is 0.0 to 2.0 GPa greater than the Young's modulus of the elastic layer which is determined by a nanoindentation method.

14 Claims, 6 Drawing Sheets

INTERMEDIATE TRANSFER MEMBER FOR USE IN ELECTROPHOTOGRAPHIC IMAGE FORMING APPARATUS

CROSS REFERENCE TO RELATED APPLICATIONS

This is a U.S. national stage of application No. PCT/JP2008/059555, filed on 23 May 2008. Priority under 35 U.S.C. §119(a) and 35 U.S.C. §365(b) is claimed from Japanese Application No. 2007-138893, filed 25 May 2007, the disclosure of which is also incorporated herein by reference.

TECHNICAL FIELD

The present invention relates to an intermediate transfer member.

TECHNICAL BACKGROUND

As a system to transfer a toner image on an electrophotographic photoreceptor (hereinafter, also denoted simply as a photoreceptor) onto a recording material, there has been known an image forming system using an intermediate transfer member. In such system, one additional transfer step is introduced to the steps of transferring a toner image from an electrophotographic photoreceptor to a recording material, in which the toner image is transferred primarily from an electrophotographic photoreceptor to an intermediate transfer member and then, the primary transfer image on the intermediate transfer member is secondarily transferred to the recording material. This system is a multiple transfer system in a so-called full-color image forming apparatus to reproduce a color-separated original image through subtractive color mixing by use of black, cyan, magenta and yellow toners in which the individual color toner images are sequentially transferred primarily from the photoreceptor to an intermediate transfer member and finally, the full-color toner image from the intermediate transfer member to a transfer material.

There was disclosed an intermediate transfer member having an elastic layer (as described in, for example, Patent documents 1-3).

Such an intermediate transfer member having an elastic layer has been noticed, the use of which achieved reduction of the concentrated load onto a toner image, resolving problems relating to lack of text images within a toner image.

Patent document 1 reports an example in which an inorganic coating layer is provided on an elastic layer to improve cleaning capability, preventing the surface of an intermediate transfer member from staining due to a toner. Patent document 2 reports an example of forming a highly hard, smooth cover layer on an elastic body. However, the use of such intermediate transfer members resulted in reduced transfer performance of from the intermediate transfer member to a transfer material, due to a hard cover layer formed on the elastic body, producing such problems as lack of text images or scattering of toner particles.

Further, in Patent document 3, a fluorine compound bonded to the surface was highly soft, producing abrasion marks due to friction onto a cleaning blade, resulting in deterioration of images.

Patent document 1: JP 2000-206801A

Patent document 2: JP 2006-259581A

Patent document 3: JP 2003-165857

DISCLOSURE OF THE INVENTION

Problem to be Solved

It is an object of the present invention to provide an intermediate transfer member which enables to maintain superior secondary transferability and enhanced cleaning capability and is also capable of continuing to obtain toner images of superior text reproduction and high quality without lack of text images even when making prints of a large number of sheets (e.g., 160,000 sheets).

Means to Resolve the Problem

The present invention was achieved by the following constitution.

1. An intermediate transfer member for use in an image forming apparatus having a device capable of transferring a toner image carried on a surface of an electrophotographic photoreceptor primarily to an intermediate transfer member, and secondarily transferring the toner image from the intermediate transfer member to a transfer material, wherein the intermediate transfer member is provided with an elastic layer on a circumference of a resin substrate and further thereon a surface layer, wherein the surface layer exhibits a layer thickness of 10 to 500 nm, a Young's modulus of a surface of the intermediate transfer member which is determined by a nanoindentation method is 0.1 to 5.0 GPa and is 0.0 to 2.0 GPa greater than a Young's modulus of the elastic layer which is determined by a nanoindentation method.

2. The intermediate transfer member as described in the foregoing 1, wherein the Young's modulus of the surface of the intermediate transfer member which is determined by a nanoindentation method is 0.1 to 2.0 GPa and is 0.0 to 2.0 GPa greater than a Young's modulus of the elastic layer which is determined by a nanoindentation method.

3. The intermediate transfer member as described in the foregoing 1, wherein the Young's modulus of the surface of the intermediate transfer member which is determined by a nanoindentation method is 0.1 to 1.0 GPa and is 0.0 to 1.0 GPa greater than a Young's modulus of the elastic layer which is determined by a nanoindentation method.

4. The intermediate transfer member as described in any of the foregoing 1 to 3, wherein the surface layer exhibits a layer thickness of 30 to 300 nm.

5. The intermediate transfer member as described in any of the foregoing 1 to 4, wherein the surface layer comprises at least one hard layer, or at least one hard layer and at least one low surface-energy layer.

6. The intermediate transfer member as described in the foregoing 5, wherein the hard layer is a layer formed of at least one of a metal oxide, a silicon compound and a carbon film.

7. The intermediate transfer member as described in the foregoing 5 or 6, wherein the low surface-energy layer is a fluorine- or chlorine-containing layer.

8. The intermediate transfer member as described in any of the foregoing 1 to 7, wherein the elastic layer comprises at least one elastic layer, or at least one elastic layer and at least one intermediate layer.

9. The intermediate transfer member as described in the foregoing 8, wherein the intermediate layer is formed of at least one of a metal oxide, a silicon compound and a carbon membrane.

10. The intermediate transfer member as described in any of the foregoing 1 to 9, wherein a Young's modulus of the elastic layer which is determined by a nanoindentation method is 0.1 to 2.0 GPa.

11. The intermediate transfer member as described in any of the foregoing 1 to 9, wherein a Young's modulus of the elastic layer which is determined by a nanoindentation method is 0.1 to 1.0 GPa.

12. The intermediate transfer member as described in any of the foregoing 1 to 11, wherein the elastic layer is a layer formed of at least one of a chloroprene rubber, a nitrile rubber, a styrene-butadiene rubber, a silicone rubber, a urethane rubber and an ethylene-propylene copolymer.

13. The intermediate transfer member as described in any of the foregoing 1 to 12, wherein a Young's modulus of the resin substrate which is determined by a nanoindentation method is 5.0 to 15 GPa.

14. The intermediate transfer member as described in any of the foregoing 1 to 13, wherein the resin substrate is formed of at least one of a polyimide, a polycarbonate and a poly (phenylene sulfide).

Effect of the Invention

The intermediate transfer member of the present invention achieves superior advantageous effects, which enables to maintain superior secondary transferability and enhanced cleaning capability and is also capable of continuing to obtain toner images of superior text reproduction and high quality without lack of text images even when making prints of a large number of sheets (for example, 160,000 sheets).

Figure 1:
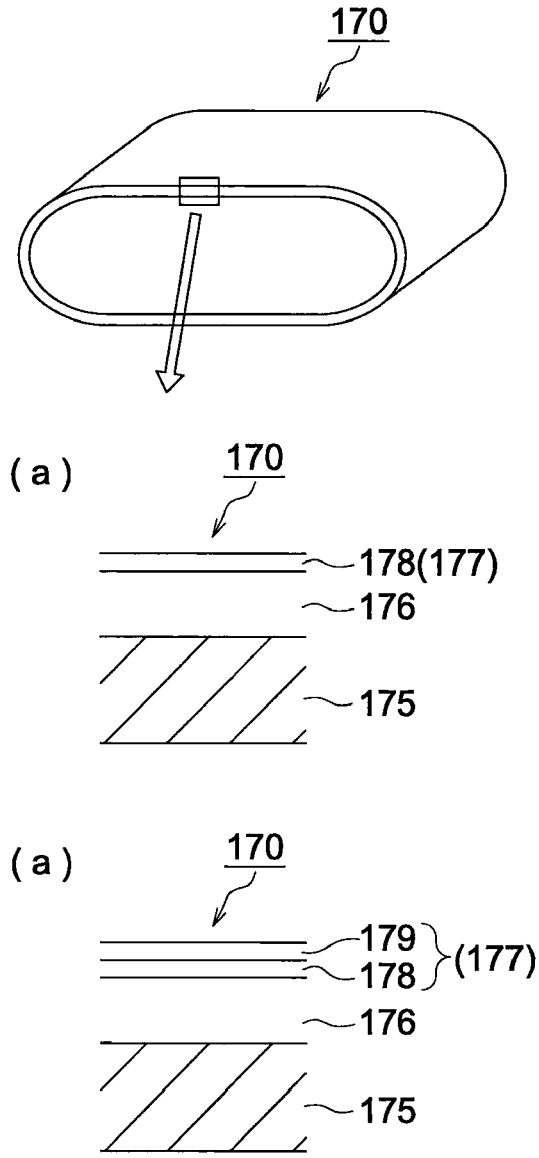
FIG. 1 illustrate a section showing a layer arrangement of an intermediate transfer member.

| DESCRIPTION OF DESIGNATIONS |
|---|
| 170: Intermediate transfer member |
| 175: Resin substrate |
| 176: Elastic layer |
| 177: Surface layer |
| 178: Hard layer |
| 179: Low surface-energy layer |

PREFERRED EMBODIMENTS OF THE INVENTION

It was found by the inventors of this application that forming the structure of a soft elastic layer sandwiched with a resin substrate and a hard surface layer, and setting specific values of a Young's modulus for the surface of an intermediate transfer member and determined by the nanoindentation method, and a difference between the Young's modulus of the surface of an intermediate transfer member and that of the elastic layer enabled to extract optimum properties of the elastic layer and the surface layer. As a result thereof, there were achieved superior characteristics, such as enhanced transferability and its maintenance, maintenance of cleaning capability, inhibition of occurrence of lack of text images and maintenance of text reproducibility.

It was not clearly understood the reason that an intermediate transfer member having a structure of a soft elastic layer sandwiched between a resin substrate and a hard surface layer achieved superior characteristics, as described above, but it is presumed as below.

When a toner image formed on the photoreceptor surface is transferred to an intermediate transfer member, the surface of the intermediate transfer member is supposed to be deformed when pressed by a toner. In cases where an elastic layer forming an intermediate portion of an intermediate transfer member is soft and a surface layer is hard, the deformation volume is lessened and the contact area of the intermediate transfer member with a toner becomes less, resulting in enhanced transferability from the intermediate transfer member to the transfer material. On the other hand, it was a concern that a reduced contact area of the intermediate transfer member with a toner led to a lowering of primary transferability, but it was proved that such a lowering of primary transferability was not caused within the range of the Young's modulus, as defined in the present invention. Thus, when the Young's modulus of an intermediate transfer member falls within a range defined in the present invention, enhanced secondary transferability can be achieved without vitiating primary transferability of an elastomer.

Further, after a toner on an intermediate transfer member is transferred onto a transfer material, any residual toner remained on the intermediate transfer member, without being transferred, is cleaned by a cleaning member (for example, a cleaning blade or a fur brush). When the surface of an intermediate transfer member is provided with, thereon, a surface layer, as defined in the present invention, such a residual toner is clearly cleaned off without damaging the surface of an intermediate transfer member. Thereby, toner images of high quality can be continuously obtained without causing staining of printed images, accompanied by printing trouble, even when printing a large number of sheets.

The intermediate transfer member can achieve further enhanced secondary-transfer efficiency or inhibition of adhesion of foreign materials by providing a low surface-energy layer on the surface.

The intermediate transfer member of the present invention exhibits the characteristics described below:

1. a structure in which an elastic layer is provided on the outer circumference of a resin substrate and further thereon, a surface layer is provided;

2. the thickness of the surface being from 10 to 500 nm, preferably from 30 to 300 nm;

3. the Young's modulus of the surface of an intermediate transfer member, determined by the nanoindentation method being from 0.1 to 5.0 GPa, preferably from 0.1 to 1.0 GPa;

4. a Young's modulus of the surface of an intermediate transfer member, determined by the nanoindentation method is 0.0 to 2.0 GPa greater than the Young's modulus of the elastic layer, determined by the nanoindentation method by 0.0 to 2.0 GPa, preferably 0.0 to 1.0 GPa.

The foregoing characteristics enable to obtain toner images of high quality without causing lack of text images and damaging the surface of an intermediate transfer member.

The present invention will be further described below.

The intermediate transfer member of the present invention is provided with an elastic layer on the outer circumference of a resin substrate and further thereon, a surface layer is provided. The surface layer comprises at least one hard layer, or at least one hard layer and at least one layer of low-surface energy.

FIG. 1 illustrates a section showing an example of the layer arrangement of an intermediate transfer member.

In the drawing, the numeral 170 designates an intermediate transfer member, the numeral 175 designates a resin substrate, the numeral 176 designates an elastic layer, the numeral 177 designates a surface layer, the numeral 178 designates a hard layer and the numeral 179 designates a low surface-energy layer.

In FIG. 1, (a) illustrates an intermediate transfer member 170 of a layer arrangement in which an elastic layer 176 is provided on the outer circumference of a resin substrate 175 and thereon, a hard layer 178 as a surface layer 177 is provided.

In FIG. 1, (b) illustrates an intermediate transfer member 170 of a layer arrangement in which an elastic layer 176 is provided on the outer circumference of a resin substrate 175 and thereon, a hard layer 178 as a surface layer 177 is provided, and further thereon is provided a low surface-energy layer 179.

The layer arrangement of an intermediate transfer member may be either (a) of FIG. 1 or (b) of FIG. 1, but the layer arrangement of (b) of FIG. 1 in which a low surface-energy layer is provided on a hard layer is preferred in terms of cleaning property.

Next, there will be described a resin substrate, an elastic layer and a surface layer.

Resin Substrate

A resin substrate exhibits a rigidity which avoids deformation of an intermediate transfer member, caused by a load which is applied from a cleaning belt to an intermediate transfer belt, and resulting in a reduced influence onto the transfer section. A resin substrate is formed preferably by using a material exhibiting a Young's modulus of 5.0 to 15.0 GPa (more preferably, 8.0 to 15.0 GPa), determined by the nanoindentation method.

Examples of a material achieving such performance include resin materials such as a polycarbonate, poly(phenylene sulfide), polyfluorovinylidene, polyimide, polyamidoimide (PAI), polyether, ether ketone, polyester, polyether, polyamide and fluoroethylene-ethylene copolymer; and resin materials formed of these as a main raw material. Of these, a polyimide, polyamidoimide (PAI), polycarbonate and poly (phenylene sulfide) is preferred. These resin materials exhibit a Young's modulus of 5.0 GPa, determined by the nanoindentation method and satisfy mechanical characteristics as a resin substrate.

There may be employed, as a material to form a resin substrate, a material obtained by blending the foregoing resin material with an elastic material, as described below. Examples of such an elastic material include a polyurethane, EPDM, hydrogenated polybutadiene, butyl rubber, and silicone rubber. These materials may be used alone or in combination.

Of these, inclusion of a poly(phenylene sulfide) or polyimide resin is preferred. A polyimide resin is formed by heating a polyamic acid of a precursor of a polyimide resin. A polyamic acid is also obtained by dissolving an approximately equimolar mixture of a tetracarboxylic acid di-anhydride or its derivative and a diamine in a polar organic solvent and allowing them to react in a solution state.

In the present invention, when using a polyimide resin for a resin substrate, the content of the polyimide resin of the resin substrate is preferably not less than 51%.

A resin substrate relating to the present invention is preferably a seamless belt or a drum prepared by adding an electrically conductive material to a resin material so that the electrical resistance (volume resistivity) is $10^5$ to $10^{11}\Omega\cdot$cm.

An electrically conductive material to be added to a resin material may use a carbon black. Such a carbon black may use a neutral or acidic carbon black. The addition amount of an electrically conductive material depends on its kind but it is added in such an amount that the volume resistivity and the surface resistivity of an intermediate transfer member falls within a prescribed range and usually in an amount of 10 to 20 parts by mass, and preferably 10 to 16 parts by mass per 100 parts of resin material.

Elastic Layer

An elastic layer relating to the present invention can be formed of at least one of a chloroprene rubber, nitrile rubber, styrene-butadiene rubber, silicone rubber, urethane rubber, and ethylene-propylene copolymer.

An elastic layer may be one formed of a material obtained by blending a resin material described above and an elastic material. Example of such an elastic material include a polyurethane, chlorinated polyisoprene, nitrile rubber, chloroprene rubber, ethylene-propylene copolymer, hydrogenated polybutadiene, butyl rubber and silicone rubber. These may be used alone or in combination.

An elastic layer may have a constitution including an intermediate layer to inhibit cracking of the surface layer. A preparation method or a layer thickness of such an intermediate layer is not specifically limited so long as the Young's modulus of the elastic layer exceeds the range of 0.1 to 5.0 GPa, but an atmospheric plasma method is preferred, which is capable of forming a layer exhibiting a relatively low internal stress and scarcely causing cracking. The Young's modulus of an elastic layer as a whole is controllable by material or thickness of an intermediate layer.

The Young's modulus of an elastic layer, determined by the nanoindentation method is preferably 0.1 to 2.0 GPa and more preferably 0.1 to 1.0 GPa.

The thickness of an elastic layer is preferably 100 to 500 μm.

The elastic layer relating to the present invention preferably is a layer prepared by dispersing a conductive substance in an elastic material so that an electrical resistance (volume resistivity) is $10^5$ to $10^{11}\Omega\cdot$cm.

Examples of such a conductive substance to be added to an elastic layer include carbon black, zinc oxide, tin oxide and silicon carbide. There is also usable a neutral or acidic carbon black. The amount of a conductive substance to be used is dependent of its kind but it is added in such an amount that a volume resistivity and a surface resistivity of an elastic layer falls within a prescribed range and usually in an amount of 10 to 20 parts by mass, and preferably 10 to 16 parts by mass per 100 parts of resin material.

Surface Layer

A surface layer is constituted of a hard layer, or a hard layer and a low surface-energy layer.

The surface of an intermediate transfer member provided with a surface layer exhibits a Young's modulus determined by the nanoindentation method of 0.1 to 5.0 GPa, preferably 0.1 to 2.0 GPa and more preferably 0.1 to 1.0 GPa.

Hard Layer

A hard layer is preferably a metal oxide film, a metal oxide nitride film, a metal nitride film, a silicon film or carbon film. Specific examples thereof include metal oxide films or metal nitride films such as silicon oxide, silicon oxide nitride, silicon nitride, titanium oxide, titanium oxide nitride, titanium nitride and aluminum oxide [and amorphous carbon layer such as DLC (diamond-like carbon), as described later]. Of these, a silicon oxide film is preferred. An inorganic compound comprised of a mixture thereof is also preferred.

A hard layer of the present invention may be at least a single layer. A hard layer may have a layer structure in which its hardness gradually increases or its density gradually increases from a location immediately on an elastic layer toward the surface of a hard layer which is farthest from the elastic layer.

The thickness of a hard layer is from 10 to 500 nm, preferably from 20 to 400 nm, and more preferably from 30 to 300 nm. A hard layer is prepared preferably by an atmospheric plasma method capable of forming a layer exhibiting a low internal stress and resistance to cracking.

A layer thickness is a value obtained by measurement using MXP 21 (produced by Mac Science Corp. Specifically, the layer thickness is measured in the manner, as below.

An X-ray target source uses copper and is operated at 42 kV and 500 mA. An incident monochrometer employs a multi-layered parabolic mirror. An incident slit employs 0.05 mm×5 mm and light-receiving slit employs 0.03 mm×20 mm. Measurement is conducted in an FT method of 2θ/θ scanning system at a step width of 0.005° and 10 sec. per step within a range of 0 to 5°. An obtained reflectance curve is subjected to curve fitting by using Reflectivity Analysis Program Ver. 1 and individual parameters are determined so that a residual square sum of a measured value and a fitting curve is at the minimum.

A hard layer thickness of less than 10 nm is insufficient in durability and surface strength, causing abrasion marks due to transfer to thick film and finally, such thin film is unevenly abraded, resulting in a lowering of a transfer coefficient or transfer unevenness. A hard layer thickness of more than 1000 nm results in insufficient adhesion or bending resistance and tends to cause cracking or peeling, and is not preferable in productivity, due to increase in time for layer formation.

Low Surface-energy Layer

A low surface-energy layer relating to the present invention is a layer containing fluorine or silicon. The thickness of allow surface-energy layer is preferably from 1 to 10 nm. A method of forming a low surface-energy layer is not specifically limited but there may be performed by coating a coating solution containing fluorine or silicon onto a hard layer.

Next, there will be described a measurement method of Young's modulus by a nanoindentation method.

Measurement of Young's Modulus by Nanoindentation Method

A Young's modulus of the surface of an intermediate transfer member which is determined by a nanoindentation method is a value obtained by direct measurement of the intermediate transfer member surface.

A Young's modulus of an elastic layer which is determined by a nanoindentation method is a value measured at the time when forming an elastic layer on the resin substrate or by removal of a surface layer from an intermediate transfer member provided with the surface layer.

A measurement method of Young's modulus by a nanoindentation method is performed in such a manner that the relationship between a load and an indented depth (displacement quantity) is measured to calculate a plastic deformation hardness from measured values.

Specifically in measurement of a thin film of 1 μm or less, this method is featured in that it is not susceptible to the physical property of a resin substrate and rarely causes cracking of thin film when being indented. Accordingly, this method is generally applied to physical property measurement of an extremely thin film.

Figure 2:
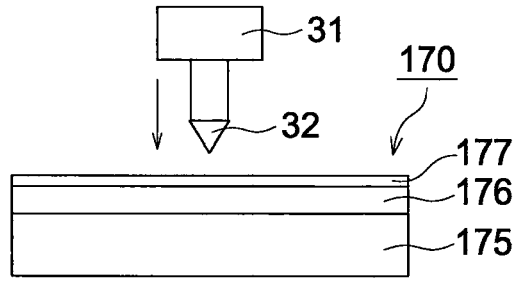
FIG. 2 is a view showing a measurement device by the nanoindentation method.

FIG. 2 illustrates an example of a measurement device to determine a Young's modulus by the nanoindentation method.

In FIG. 2, numeral 31 designates a transducer, numeral 32 designates a diamond Berkovich indenter having a regular-triangle top, numeral 170 designates an intermediate transfer member, numeral 175 designates a resin substrate, numeral 176 is an elastic layer and numeral 177 designates the surface layer.

This measurement device can measure displacement at an accuracy of nanometer by using the transducer (31) and the diamond Berkovich indenter having a regular-triangle top (32), while applying a load of a μN order. Measurement is carried out by using, for example, commercially available NANO Indenter XP/DCM (produced by MTS Systems Co./MST NANO Instruments Co.).

Figure 3:
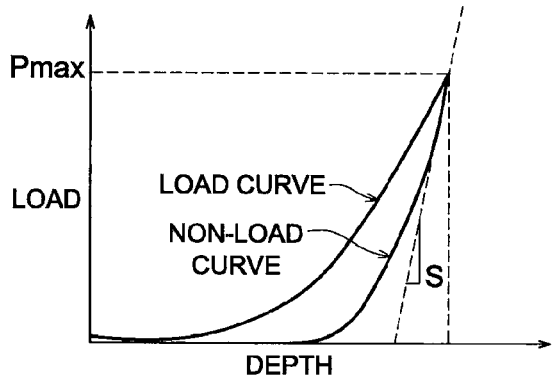
FIG. 3 shows a typical load-displacement curve obtained by the nanoindentation method.

FIG. 3 shows a typical load-displacement curve obtained in hardness measurement by the nanoindentation method.

Figure 4:
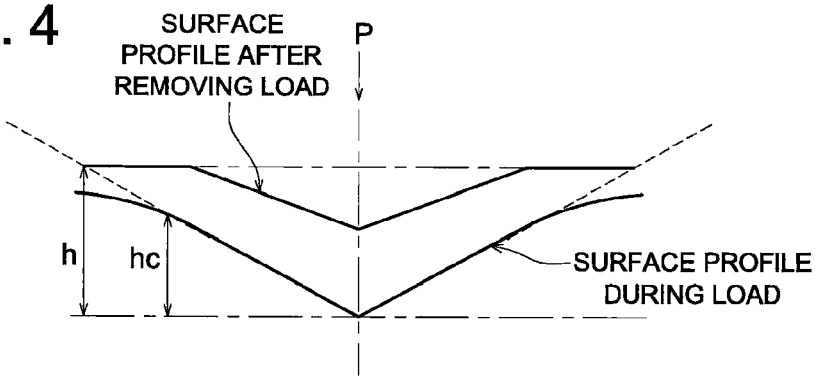
FIG. 4 is a view showing the state of a indenter being in contact with a sample.

FIG. 4 is a schematic diagram in the state of an indenter being in contact with a sample.

Hardness H is determined by the following equation (1):

$$H=P\max/A \qquad \text{Equation (1)}$$

where P is a maximum load applied to an indenter and A is a contact projection area between the indenter and a sample at that time.

The contact projection area (A) can be expressed is represented by the following equation (2) using "hc" in FIG. 4:

$$A=24.5hc^2 \qquad \text{Equation (2)}$$

where "hc" becomes shallower than the overall indented depth (h) due to elastic dent of the surface near a contact point and represented by the following equation (3):

$$hc=h-hs \qquad \text{Equation (3)}$$

where "hs" is a quantity of dent and represented by the following equation (4) in terms of a gradient (gradient S of FIG. 4) of a load curve after pressing an indenter with an indenter form:

$$hs=\epsilon\times P/S \qquad \text{Equation (4)}$$

where ϵ is a constant relating to an indenter form, for example, being 0.75 in the case of a Berkovich indenter.

The hardness of the surface of an intermediate transfer member or an elastic layer can be determined by using such a measurement device.

Measurement Condition:

Measurement device: NANO Indenter XP/DCM (produced by MTS Systems Co.),

Measurement indenter: diamond Berkovich indenter having a top form of regular triangle, Measurement environment: 20° C., 60% RH, Measurement sample: an intermediate transfer member being cut to a size of 5 cm×5 cm to prepare a measurement sample, Maximum load setting: 25 μN, Indenting rate: weighing is applied at a rate reaching a maximum load of 25 μN over 5 sec.

Each sample is measured randomly at 10 points and an average value thereof is defined as a hardness determined by the nanoindentation method.

Next, a preparation method of an intermediate transfer member will be described with reference to an example but the present invention is not limited to this.

Resin Substrate

A resin substrate of the intermediate transfer member of the present invention can employ a seamless belt formed of a resin material containing an electrically conductive substance.

A resin substrate usable in the present invention can be produced by a conventional method known in the art. For example, a resin substrate can be produced in such a manner that a material of a resin mixed with a conductive substance is melted in an extruder, extruded through a cyclic die or a T-die and rapidly cooled.

Prior to forming an elastic layer on a resin substrate, the resin substrate may be subjected to a surface treatment, such as a corona discharge treatment, a flame treatment, a plasma treatment, a glow discharge treatment, a surface-roughening treatment or a chemical treatment.

Further, there may be formed an anchor coating agent layer between an elastic layer and a resin substrate to enhance adherence. Examples of an anchor coating agent used for such an anchor coating agent layer include a polyester resin, isocyanate resin, a urethane resin, an acryl resin, ethylene vinyl alcohol resin, vinyl-modified resin, epoxy resin, modified styrene resin, modified silicone resin and alkyl titanate, which are used singly or in combination. An anchor coating agent may be added with additives known in the art. The foregoing anchor coating agent is coated on a resin substrate by a commonly known method, such as roll coating, gravure coating, knife coating, dip coating and spray coating, and anchor coating is performed by removing a solvent, diluent or the like is by drying or subjecting to UV hardening. A coating amount of the foregoing anchor coating agent is preferably 0.1 to 5 g/$m^2$ (dry state).

Elastic Layer

A resin substrate is immersed standing upright into a bath housing a coating solution for an elastic layer. After repeating immersion a few times to form coating of a prescribed thickness, the resin substrate is pulled up from the bath. Then, after dried to remove solvent, the resin substrate is subjected to a heating treatment (for example, at 6-150° C. for 60 min.) to form an elastic layer.

In cases where an intermediate layer is included within an elastic layer, such an intermediate layer can be formed in a similar manner to a hard layer described below. A Young's modulus of the whole of an elastic layer is controllable by a material or thickness of an intermediate layer.

Hard Layer

A hard layer can be formed by an atmospheric plasma CVD method.

Next, there are described a forming apparatus by an atmospheric plasma CVD method, a method thereof and a gas used therein.

Figure 5:
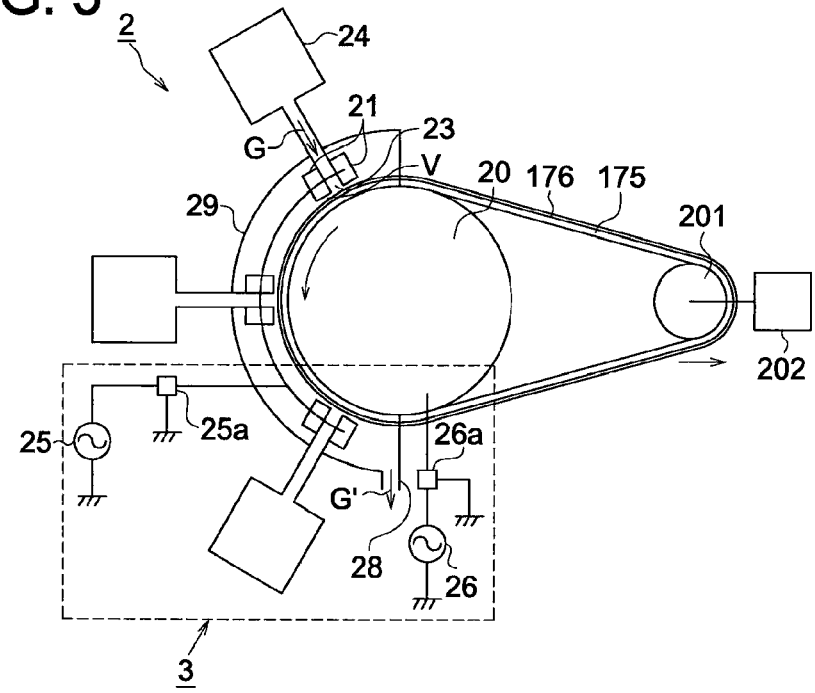
FIG. 5 illustrates a first production apparatus to produce a hard layer of an intermediate transfer member.

FIG. 5 is a schematic view showing a first production apparatus to produce a hard layer intermediate transfer member.

In FIG. 5, a first production apparatus 2 of an intermediate transfer member (a direct system in which the discharge space is almost the same as the thin-layer deposition area) is one which forms a hard layer 178 as a surface layer formed on an elastic layer 176 formed on a resin substrate 175 and is comprised of a roll electrode 20 and a driving roller 201 entraining the resin substrate 175 of a seamless belt-form intermediate transfer member 170 and rotating in the direction indicated by the arrow, and an atmospheric plasma CVD apparatus 3 as a thin-layer forming apparatus to form a hard layer 178 on the elastic layer 176.

The atmospheric plasma CVD apparatus 3 is provided with at least one set of fixed electrodes 21 disposed along the circumference of the roll electrode 20, a discharge space 23 in which the fixed electrodes 21 opposes the roll electrode 20 and discharging is performed, a mixed gas supplying device 24 to form a mixed gas G of raw material gas and discharge gas and supply the mixed gas G to a discharge space 23, a discharge vessel to reduce inflow of air into the discharge space 23, a first power source 26 connected to the roll electrode 20, a second power source connected to the fixed electrode 21, and an exhaust section 21 to exhaust an exhaust gas G'.

The mixed gas supplying device 24 supplies a raw material gas to form a layer selected from an inorganic oxide layer and an inorganic nitride layer and a gas mixture including nitrogen gas or argon gas to the discharge space 23. It is preferred to mix oxygen gas or hydrogen gas to accelerate the reaction through oxidation-reduction reaction.

The driving roller 201 is energized by a tension-energizing means 202 in the direction indicated by the arrow and applies a prescribed tension to a substrate 175. The tension-energizing means 202 releases application of tension when replacing the substrate 175, rendering easy replacement of the substrate 175.

A first power source 26 outputs a voltage of frequency ω1 and a second power source 25 outputs a voltage of frequency ω2 and these voltages generate electric field V formed by overlapping frequencies ω1 and ω2 in the discharge space 23. The discharge gas is energized to form a plasma state by the electric field V and a thin-layer corresponding to a raw material gas contained in the mixed gas G (hard layer 178) is deposited on the surface of the substrate 175.

Alternatively, a hard layer 175 may be stacked by plural fixed electrodes located downstream in the rotational direction of a roll electrode and a mixed gas supplying device, whereby the hard layer 175 is controlled.

The hard layer 178 is deposited by a fixed electrode located most downstream in the rotational direction of the electrode among plural fixed electrodes and a mixed gas supplying device, while another layer, for example, an adhesion layer to enhance adhesion of the hard layer 178 and the elastic layer 176 is formed by another fixed electrode and the mixed gas supplying device located upstream and another mixed gas supplying device.

Further, to achieve enhanced adhesion of the hard layer 178 to the elastic layer 176, a gas supplying device to supply a gases such as argon or oxygen and a fixed electrode may be provided upstream from a fixed electrode and a mixed gas supplying device to supply gas such as argon or oxygen to perform plasma treatment, thereby activating the surface of the elastic layer 176.

As described above, the intermediate transfer member 1 is entrained about paired rollers, one of the paired rollers is one electrode of paired electrodes, at least one fixed electrode of the other electrode is provided along the outer circumference of a roller of said one electrode, an electric field is induced between electrodes under atmospheric pressure to perform plasma discharging to deposit a thin layer on the surface of the intermediate transfer member, rendering it feasible to produce an intermediate transfer member exhibiting enhanced transferability and superior cleaning property and improved durability.

Figure 6:
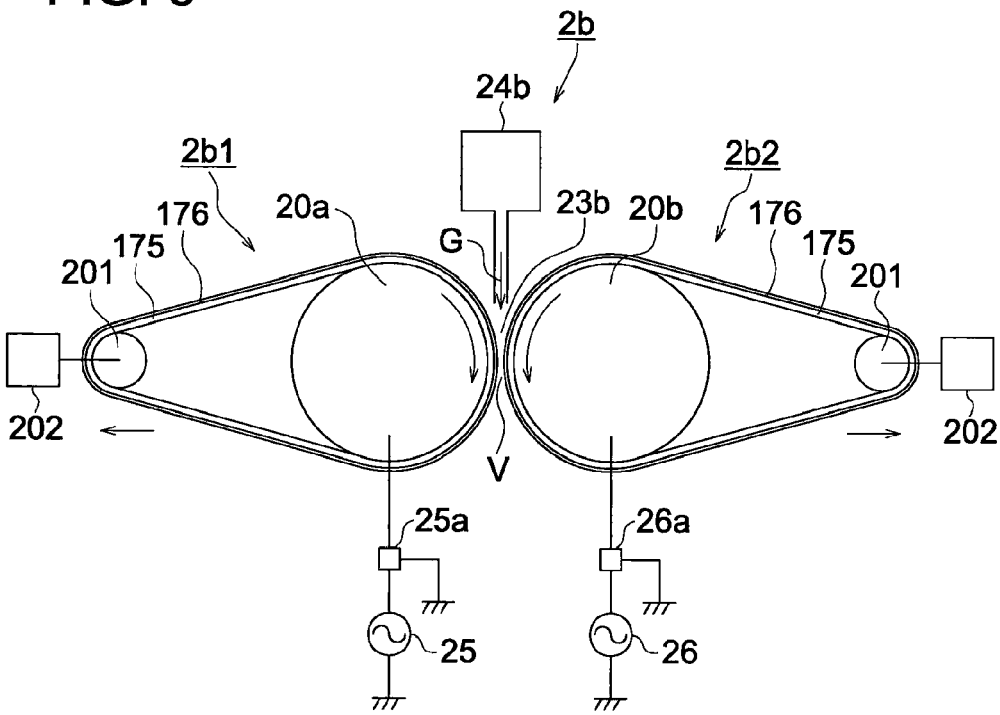
FIG. 6 illustrates a second production apparatus to produce a hard layer of an intermediate transfer member.

FIG. 6 illustrates a second production apparatus to produce a hard layer of an intermediate transfer member.

A second production apparatus 2*b* of an intermediate transfer member simultaneously forms hard layers on elastic layer provided on plural resin substrates, and is mainly constituted of film forming devices 2*b*1 and 2*b*2 to form a hard layer on a elastic layer.

The second production apparatus 2*b* (which is a deformed direct system and performs discharging and thin-layer deposition between opposed roll electrodes) is provided with a first film forming device 2*b*1 and a second film forming device 2*b*2 which are separated at a prescribed distance, and a mixed gas supplying device 24*b* which is disposed between the first film forming device 2*b*1 and the second film forming device 2*b*2, forms a gas mixture G of at least a raw material gas and a discharge gas and supplies the gas mixture to a discharge space 23B.

The first film forming device 2*b*1 is provided with a roll electrode 20*a* entraining a seamless form resin substrate 175 of an intermediate transfer member and rotating in the direction indicated by an arrow, a driving roller 201, a tension-energizing means 202 to energize the driving roller 201 and a first power source 25 connected to the roll electrode 20*a*; the second film forming device 2*b*2 is provided with a roll electrode 20*b* entraining a seamless form substrate 175 of an intermediate transfer member and rotating in the direction indicated by the arrow, a driving roller 201, a tension-energizing means 202 to energize the driving roller 201 and a second power source 26 connected to the roll electrode 20*b*.

Further, the second production apparatus 2*b* is provided with a discharge space 23*b* in which discharging is performed in the opposing area of the roll electrode 20*a* and the roll electrode 20*b*.

The mixed gas supplying device 24*b* supplies a raw material gas to form at least one layer selected from an inorganic oxide layer and an inorganic nitride layer and a gas mixture containing a rare gas such as nitrogen gas or argon to the discharge space 23. It is preferred to mix oxygen gas or hydrogen gas to accelerate reaction through oxidation-reduction reaction.

A first power source 25 outputs a voltage of frequency ω1 and second power source 26 outputs a voltage of frequency ω2 and these voltages generate an electric field V formed by overlapping frequencies ω1 and ω2 in the discharge space 23. Then, the mixed gas is made (or excited) to a plasma state. The mixed gas which has been made (or excited) to a plasma state is exposed to the surfaces of the elastic layer 176 of the first film forming device 2*b*1 and the elastic layer 176 of the second film forming device 2*b*2 and a layer (inorganic compound layer) corresponding to a raw material gas contained in the mixed gas which has been made (or excited) to a plasma state, is simultaneously deposited and formed on the surface of the elastic layer 176 of the first film forming device 2*b*1 and on the surface of the elastic layer 176 of the second film forming device 2*b*2.

Herein, opposed roll electrode 20*a* and roll electrode 20*b* are disposed separately at a prescribed distance.

In the following, there is described an atmospheric plasma CVD apparatus to form the hard layer 178 on the elastic layer 176.

Figure 7:
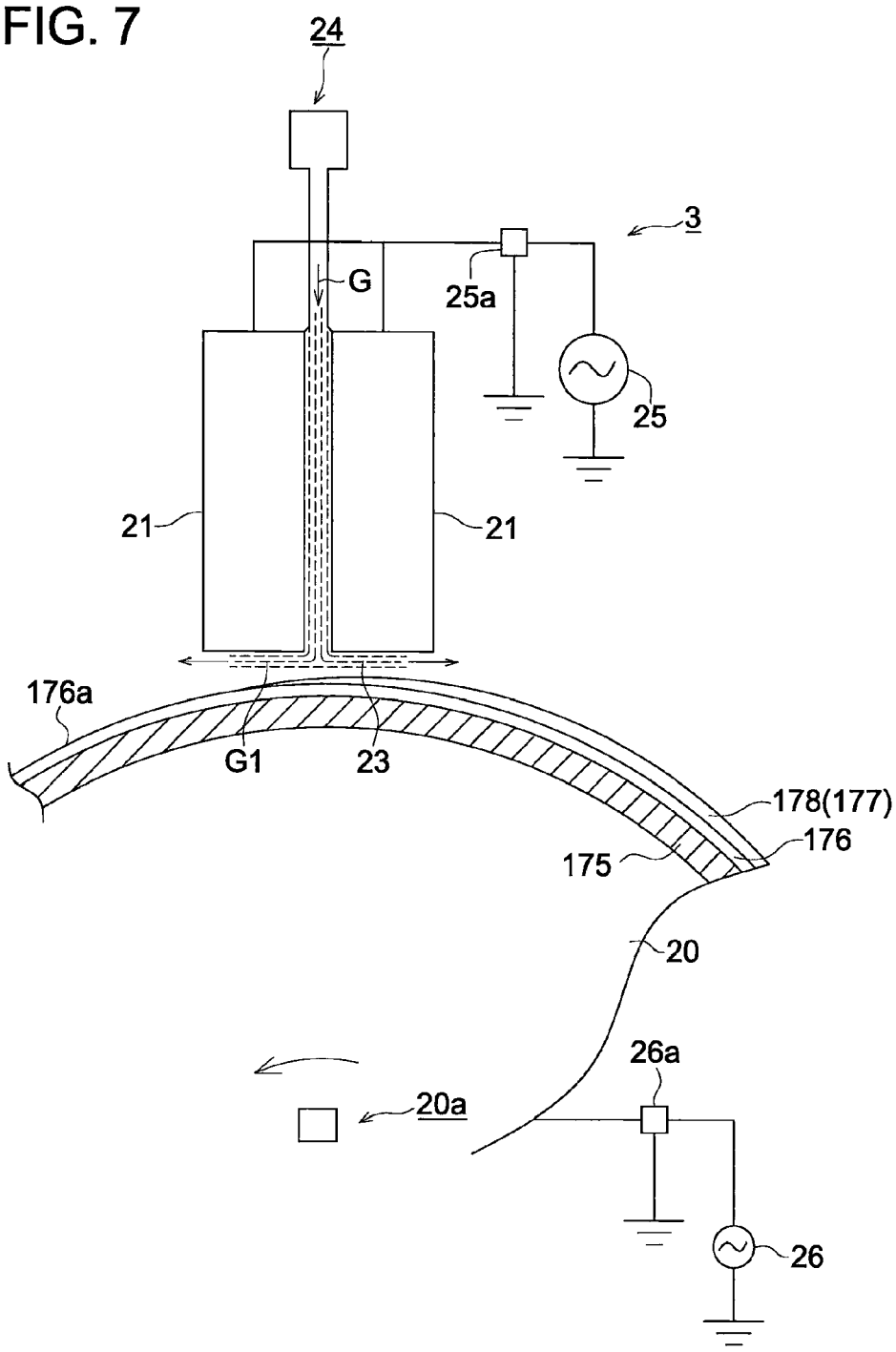
FIG. 7 illustrates a first plasma film forming apparatus to produce a hard layer of an intermediate transfer member by plasma.

FIG. 7 is an abstraction of the thin-layer forming region of the broken line portion in FIG. 5.

FIG. 7 illustrates a first plasma film-forming apparatus to produce a hard layer of an intermediate transfer member through plasma.

There will be described an example of a suitable atmospheric plasma CVD apparatus used for formation of the hard layer 178 with reference to FIG. 7.

An atmospheric plasma CVD apparatus 3 is a production apparatus of an intermediate transfer member, which is provided with at least one pair of rollers which detachably entrains the substrate and rotatably drives it and at least one pair of electrodes performing plasma discharge, wherein one electrode of the pair of electrodes is a roller of the pair of rollers and the other electrode is a fixed electrode opposed to the foregoing roller via the resin substrate, and the elastic layer is exposed to plasma generated in the opposing area of the roller and the fixed electrode to deposit and form the foregoing hard layer. When using nitrogen as a discharge gas, for example, application of a high voltage to one power source and application of a high-frequency to the other power source stably initiate discharge and continue the discharge, rendering it feasible to suitably employ the apparatus.

As described above, the atmospheric plasma CVD apparatus 3 is provided with a mixed gas supplying device 24, a fixed electrode 21, a first power source 25, a first filter 25*a*, a roll electrode 20, a driving means 20*a* to rotatably drive the roll electrode in the direction indicated by the arrow, a second power source 26 and a second filter 26*a*, and plasma discharging is performed in a discharge space 23 to excite a gas mixture G composed of a raw material gas and a discharge gas, while the elastic layer surface 176*a* is exposed to thus excited gas mixture G1 to deposit and form the hard layer 178 (surface layer 177) on the surface.

A first high-frequency voltage of frequency ω1 is applied to the fixed electrode 21 from the first power source 25 and a second high-frequency voltage of frequency ω2 is applied to the roll electrode 20 from the second power source 26, whereby an electric field overlapping the frequency ω1 at an electric field intensity V1 and the frequency ω2 at an electric field intensity V2 is generated between the fixed electrode 21 and the roll electrode 20, a current I1 is sent through the fixed electrode 21 and a current I2 is sent through the roll electrode 20, generating plasma between electrodes.

Herein, the relationship of the frequency ω1 and the frequency ω2, and the relationship of the electric field intensity V1, the electric field intensity V2 and an electric field strength IV satisfy:

$$V1 \geqq IV > V2 \text{ or } V1 > IV \geqq V2 \text{ at } \omega 1 \leqq \omega 2$$

and an output density of the second high-frequency electric field becomes not less than 1 W/cm$^2$.

The electric field intensity initiating discharge of nitrogen gas is 3.7 kV/mm, so that the electric field $V_1$ applied from the first power source 25 is preferably 3.7 kV/mm or more, and the electric field $V_2$ applied from the second high-frequency power source 60 is preferably 3.7 kV/mm or less.

Examples of the first power source 25 (high-frequency power source), which is applicable to the first atmospheric plasma CVD apparatus 3 include the commercially available ones described below, any one of which is usable.

| Applied Power Symbol | Maker | Frequency | Product Name |
|---|---|---|---|
| A1 | Shinko Denki | 3 kHz | SPG3-4500 |
| A2 | Shinko Denki | 5 kHz | SPG5-4500 |
| A3 | Kasuga Denki | 15 kHz | AGI-023 |
| A4 | Shinko Denki | 50 kHz | SPG50-4500 |
| A5 | Haiden Laboratory | 100 KHz* | PHF-6k |
| A6 | Pearl Ind. | 200 kHz | CF-2000-200k |
| A7 | Pearl Ind. | 400 kHz | CF-2000-400k |
| A8 | SEREN IPS | 100-460 kHz | L3001 |

Examples of the second power source 26 (high-frequency power source) include the following, any one of which is usable.

| Applied Power Symbol | Maker | Frequency | Product Name |
|---|---|---|---|
| B1 | Pearl Ind. | 800 kHz | CF-2000-800k |
| B2 | Pearl Ind. | 2 MkHz | CF-2000-2M |
| B3 | Pearl Ind. | 13.56 MkHz | CF-5000-13M |
| B4 | Pearl Ind. | 27 MkHz | CF-2000-27M |
| B5 | Pearl Ind. | 150 MkHz | CF-2000-150M |
| B6 | Pearl Ind. | 20-99.9 MkHz | RP-2000-20/100M |

Of the foregoing power sources, the asterisk mark (*) indicates Haiden Res. Lab. Impulse high-frequency power source (100 kHz in the continuous mode). Otherwise, they are a high-frequency power source applicable only by a continuous sine wave.

In the present invention, electric power supplied between opposed electrodes from the first and second power sources is supplied at a power (output density) of 1 W/cm$^2$ and the discharge gas is excited to a plasma state, thereby forming a thin-layer. The upper limit of power supplied to the fixed electrode 21 preferably is 50 W/cm$^2$, while the lower limit preferably is 1.2 W/cm$^2$. A discharge area (cm$^2$) refers to an area of the region causing discharge in the electrode.

Supplying power (output density) at 1 W/cm$^2$ or more (preferably, 2 W/cm$^2$ or more) to the roll electrode 20 results in enhanced output density, while maintaining uniformity of the electric high-frequency field. Thereby, a further uniform, high-density plasma can be formed, achieving compatibility of enhanced film-forming speed and enhanced film quality. The upper limit of power supplied to the roll electrode 20 is preferably 50 W/cm$^2$.

Herein, the waveform of a high-frequency electric field is not specifically limited and includes, for example, a continuous oscillation mode of a continuous sine wave form, called continuous oscillation mode and an intermittent oscillation mode intermittently performed on-off, called intermittent oscillation mode. Either one can be adopted but a high-frequency wave supplied to at least roll electrode 20 is preferably a continuous sine wave, whereby formation of a dense and high quality thin-layer is achieved.

Further, the first filter 25*a* is provided between the fixed electrode 21 and the first power source 25, thereby causing an electric current to flow from the first power source 25 to the fixed electrode 21 to be easily passed, and an electric current from the second power source 26 is grounded, thereby making it difficult to cause a current from the second power source 26 to the first power source 25 to pass; the second filter 26*a* is provided between the roll electrode 20 and the second power source 26, thereby causing an electric current from the second power source 26 to the roll electrode 20 to easily pass, and an electric current from the first power source 21 is grounded, thereby making it difficult to cause current from the first power source 25 to the second power source 26 to pass.

It is preferred to employ an electrode capable of maintaining a uniform and stable discharge state upon application of a strong electric field to the electrode. The electrode surface of at least one of the fixed electrode 21 and the roll electrode 20 is covered with a dielectric described below to be resistant to a strong electric field.

In the foregoing relationship of an electrode and a power source, the fixed electrode 21 and the roll electrode 20 may be connected to the second power source 26 and the first power source 25, respectively.

FIG. 8 is a perspective view showing an example of a roll electrode.

Figure 8A:
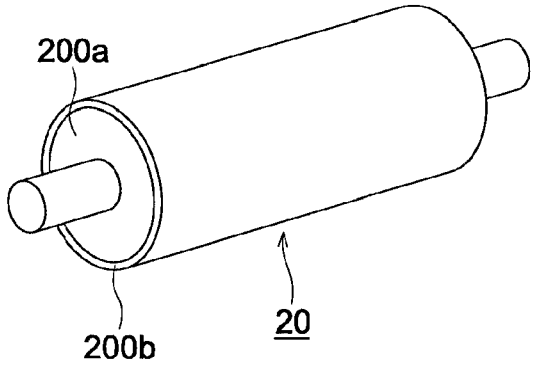
FIG. 8 shows a schematic view of an example of a roll electrode.

There will be described the constitution of the roll electrode 20. As shown in FIG. 8*a*, a roll electrode 20 is comprised of an electrically conductive base material 200*a*, such as a metal (hereinafter, denoted also as a electrode base material), which is thermally sprayed with a ceramic and then covered with a ceramic-covered dielectric 200*b* having been subjected to a hole-sealing treatment (hereinafter, also denoted simply as a dielectric). Preferred ceramic materials for use in such thermal-spraying include, for example, alumina and silicon nitride and of these, alumina is more preferred in terms of easier processability.

Figure 8B:
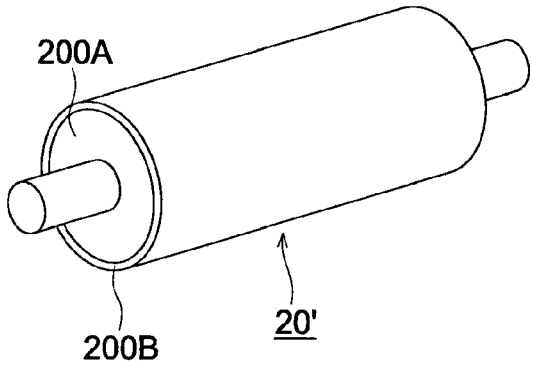

As shown in FIG. 8*b*, a roll electrode 20' may be comprised of an electrically conductive base material 200A such as a metal, which is covered with a lining-treated dielectric 200B having been provided with an inorganic material lining. There are preferably used lining materials such as a silicate glass, a borate glass, a phosphate glass, a germanate glass, a tellurite glass, an aluminate glass and a vanadate glass. Of these, a borate glass is more preferred in terms of easy processability.

Examples of the conductive base material 200*a* or 200A include silver, platinum, stainless steel, aluminum and iron, and of these, stainless steel is preferred in terms of easier processability.

In one of the embodiments of the invention, a base material used for a roll electrode 200*a* or 200A employs a stainless steel jacket roll base material incorporating a cooling means (not shown in the drawing).

FIG. 9 is a perspective view showing an example of a fixed electrode.

Figure 9A:
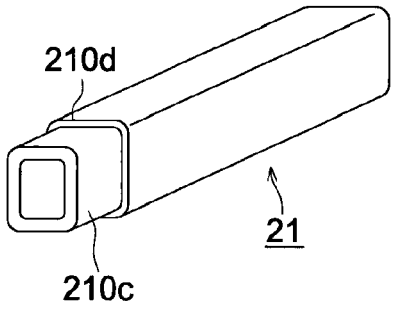
FIG. 9 shows a schematic view of an example of a fixed electrode.
Figure 9B:
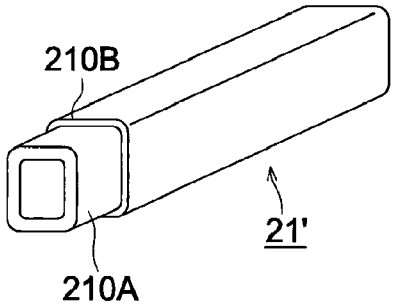

In FIG. 9*a*, a fixed electrode 21 of a square pillar or square barrel pillar is comprised of an electrically conductive base material 210*c*, such as a metal, which is thermally sprayed with a ceramic and then covered with a ceramic-covered dielectric 210*d* having been subjected to a hole sealing treatment, similarly to the roll electrode 20. Further, as shown in FIG. 9*b*, a fixed electrode 21' of a square pillar or square barrel pillar may be comprised of an electrically conductive base material 210A such as a metal, which is covered with a lining-treated dielectric 210B having been provided with an inorganic material lining.

In the following, there will be described an example of a film-forming step in the process of producing an intermediate member, comprising depositing the hard layer 178 on the elastic layer 176 formed on the on the resin substrate 175 to form an inorganic compound layer, with reference to FIGS. 5 and 7.

In FIGS. 5 and 7, after the substrate 175 is entrained about the roll electrode 20 and the driving roller 201, a prescribed tension is applied to the substrate 175 by the action of the tension-energizing means 202 and subsequently, the roll electrode 20 is rotatably driven at a prescribed rotation speed.

The mixed gas G which is formed from the mixed gas supplying device 24*b* is released into the discharge space 23.

A voltage of frequency ω1 is outputted from a first power source 25 and applied to a fixed electrode 21, and then, a voltage of frequency ω2 is outputted from a second power source 26 and applied to a roll electrode 20 and frequencies ω1 and ω2 are superimposed to the discharge space by these voltages to generate an electric space.

The mixed gas which has been released to the discharge space 23 is excited to a plasma state. Then, the substrate surface is exposed to the mixed gas G, being in a plasma state, whereby a raw material gas contained in the mixed gas G forms at least one layer selected from an inorganic oxide layer, an inorganic nitride layer and an inorganic carbide layer, that is, the hard layer 178 (surface layer 177) on the elastic layer 176.

The thus formed hard layer may be comprised of plural layers, but at least one layer of the plural layers preferably exhibits a carbon content of 0.1 to 20% by number of atoms which is determined in the XPS measurement and such a carbon atom-containing layer is located preferably closer to the elastic layer.

In the foregoing atmospheric plasma. DVD apparatus 3, for example, a mixture gas (discharge gas) is subjected to plasma excitation between paired electrodes (roll electrode 20 and fixed electrode 21) and a raw material gas containing carbon atoms which exists in plasma is radicalized and exposes the surface of the elastic layer 176. Then, a carbon-containing molecule or a carbon-containing radical is exposed to the surface of the elastic layer 176 is included in the hard layer.

The discharge gas refers to a gas which has been excited to a plasma state by the foregoing conditions and including, for example, nitrogen, argon, helium, neon, krypton, xenon and mixtures thereof. Of these gases, nitrogen, helium and argon are preferred and nitrogen is cheap and preferable.

Raw material gas to form a hard layer employs organic metal compounds which are gas or liquid at ordinary temperature, specifically, an alkyl metal compound, a metal alkoxide compound or an organic metal complex compound. The phase state of these raw materials is not necessarily a gas phase at ordinary temperature and ordinary pressure, and either liquid phase or solid phase is usable if it can be gasified via melting, distillation or sublimation.

A raw material gas is one which is in a plasma state in a discharge space and contains a component capable of forming a thin-layer and examples thereof include an organic metal compound and an organic compound.

Example of a silicone compound include silane, tetramethoxysilane, tetraethoxysilane (TEOS), tetra-n-propoxysilane, tetraisopropoxysilane, tetra-n-butoxysilane, tetra-t-butoxysilane, dimethyldimethoxysilane, dimethyldiethoxysilane, diethyldimethoxysilane, diphenyldimethoxysilane, methyltrimethoxysilane, ethyltrimethoxysilane, phenyltrimethoxysilane, (3,3,3-trifluoropropyl) trimethoxysilane, hexamethyldisilane, bis(dimethylamino) dimethylsilane, bis(dimethylamino)methylvinylsilane, bis (ethyl-amino)dimethylsilane, N,O-bis(trimethylsilyl) acetoamide, bis(trimethylsilyl)carbodiimide, diethylaminotrimethylsilane, dimethylaminodimethylsilane, hexamethyldisilane, hexamethylcyclotrisilazane, nonamethyltrosilazane, octamethylcyclotetrasilazane, tetrakisdimethylaminosilane, tetraisocyanatosilane, tetramethyldisilane, tris(dimethylamino)silane, triethoxyfluorosilane, allyldimethylsilane, allylytimethylsilane, benzyltrimethylsilane, bis (trimethylsilyl)acetylene, 1,4-bisbistrimethylsilyl-1,3-butadiene, di0t-butylsilane, 1,3-disilabutane, bis(trimethylsilyl) methane, cyclopentadienyltrimethylsilane, phenyldimethylsilane, phenylrimethylasilane, propargyltrimethylsilane, tetramethylsilane, trimethylsilylacetylene, 1-(trimethylsilyl)-1-propyne, tris(trimethylsilyl)methane, tris(trimethylsilyl)silane, vinyltrimethylsilane, hexamethyldisilane, octamethylcyclotetrasiloxane, tetramethylcyclotetrasiloxane, hexamethylcyclotetrasiloxane, and M silicate 51, but are not limited to these.

Titanium compounds include, for example, an organic metal compound such as tetramethylaminotitanium; a metal hydride compound such as titanium monohydride or titanium dihydride; a metal halide compound such as titanium dichloride, titanium trichloride or titanium tetrachloride; and a metal alkoxide such as tetraethoxytitanium, tetraisopropoxytitanium or tetrabutoxytitanium, but are not limited to these.

Examples of an aluminum compound include aluminum butoxide, aluminum s-butoxide, aluminum t-butoxide, aluminum diisopropoxide ethyl acetate, aluminum ethoxide, aluminum hexafluoropentanedionate, aluminum isoproxide, aluminum(III) 2,4-pentanedionate and dimethylaluminum chloride, but are also not limited to these.

These raw materials may be used singly or a mixture of at least two components may be used.

As described earlier, the hardness of a hard layer can be controlled by a film forming rate or a ratio of added gases.

Formation of the hard layer 178 on the elastic layer 176 by the method described earlier can provide an intermediate transfer member exhibiting enhanced transferability, improved cleaning property and improved durability.

A raw material gas to form an amorphous carbon layer (film) can employ organic compound gas which is gas or liquid at ordinary temperature, specifically, hydrocarbon gas. The phase state of these raw materials is not necessarily a gas phase at ordinary temperature and ordinary pressure, and either liquid phase or solid phase is usable if it can be gasified via melting, distillation or sublimation. Examples of a hydrocarbon gas as a raw material gas include gases containing at least a paraffinic hydrocarbon such as $CH_4$, $C_2H_6$, $C_3H_8$ and $C_4H_{10}$; an acetylenic hydrocarbon such as $C_2H_2$ and $C_2H_4$; a olefinic hydrocarbon, diolefinic hydrocarbon or an aromatic hydrocarbon. In addition to hydrocarbon, there are also usable carbon atom-containing compounds, for example, alcohols, ketones, ethers, esters, CO, $CO_2$ and the like.

These raw materials may used singly or in combination of two or more.

Low Surface-energy Layer

A low surface-energy layer refers to a layer capable of forming a state of low surface energy. Preferred examples of a compound capable of forming a low surface-energy layer include a polysiloxane compound, a fluoroalkyl polymer compound and a higher fatty acid hydrocarbon compound. Of these, a polysiloxane compound is preferred.

Next, there are described an image forming method and an image forming apparatus, each using the intermediate transfer member of the present invention.

Image Forming Method and Image Forming Apparatus

The intermediate transfer member of the present invention is suitably applicable to electrophotographic image forming apparatuses, such as a copier, a printer, facsimile and the like. An image forming method may be any one in which a toner image carried on the surface of a photoreceptor is primarily transferred on the surface of an intermediate transfer member, and the transferred toner image is held thereon and the held toner image is secondarily transferred onto the surface of a transfer material such as paper. An intermediate transfer member may be a belt form or a drum form.

First, constitution of an image forming apparatus installed with an intermediate transfer member of the invention will be described with reference to an example of a tandem type full-color copier.

Figure 10:
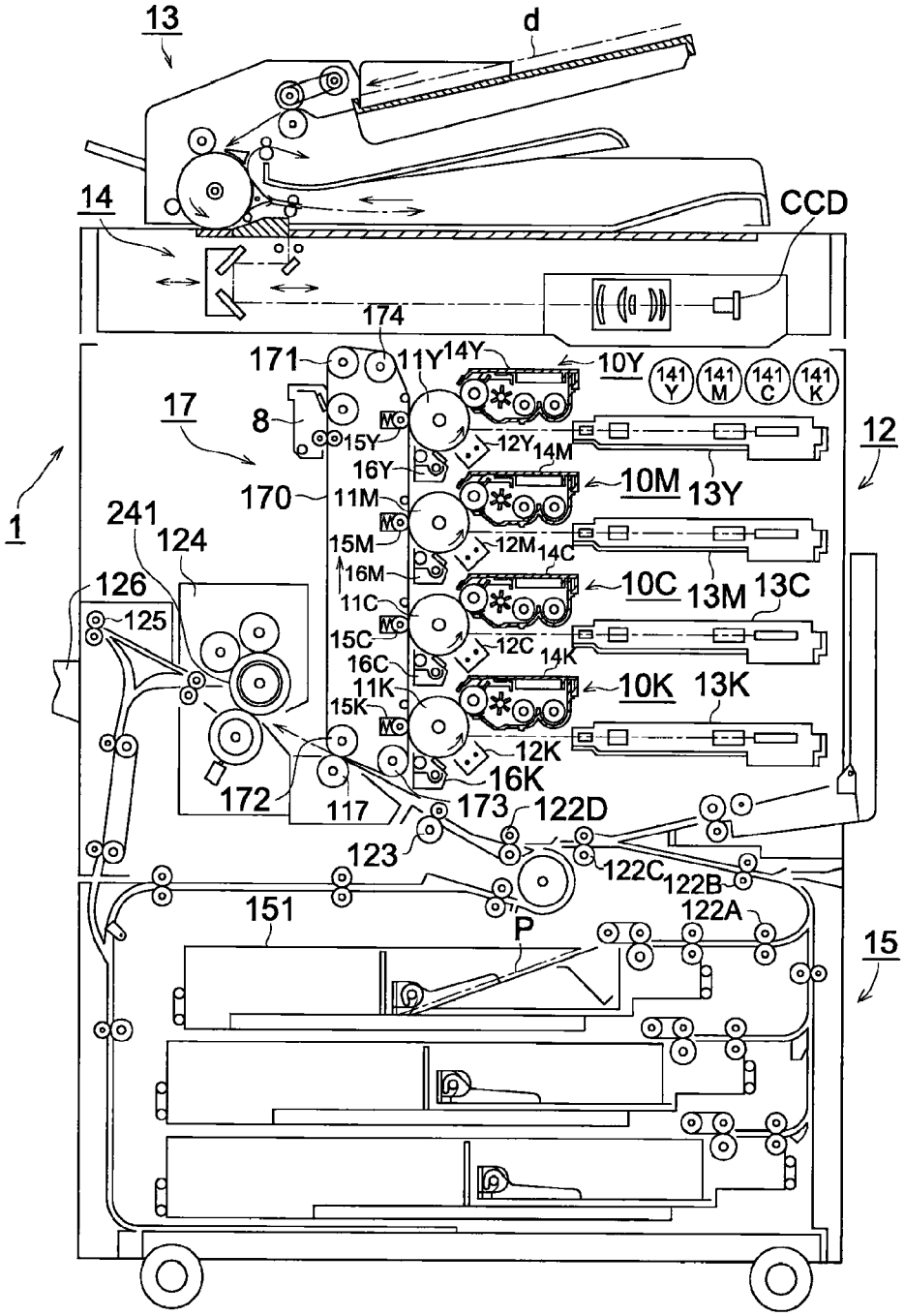
FIG. 10 is a sectional view showing an example of an image forming apparatus capable of employing an intermediate transfer member of the present invention.

FIG. 10 is a sectional view showing an example of constitution of a color image forming apparatus.

This color image forming apparatus 1 is called a tandem type full-color copier, which is comprised mainly of an automatic document feeder 13, an original image reader 14, plural exposure means 13Y, 13M, 13C and 13K, plural sets of image forming sections 10Y, 10M, 10C and 10K, an intermediate transfer member 15, a paper feeder 15 and a fixing means 124.

On the upper portion of a main body 12 of the color image forming apparatus 1 are disposed the automatic document feeder 13 and the original image reader 14. An image of a document (d) conveyed by the automatic document feeder 13 is reflected and image-formed through an optical system of the original image reader 14 and read by a line image sensor CCD.

Analog signals to which an original image read by the line image sensor CCC has been photoelectric-converted, are subjected to an analog treatment, an A/D conversion, shading correction and an image compression treatment in an image processing section (not shown in the drawing), and then transmitted to exposure means 13Y, 13M, 13C and 13K as digital data for the respective colors and latent images of the respective color image data are formed on each of drum-form photoreceptors 11Y, 11M, 11C and 11K as a first image carrier via exposure means 13Y, 13M, 13C and 13K.

The image forming sections 10Y, 10M, 10C and 10K are tandemly disposed in the vertical direction and an intermediate transfer member 170 of the invention, as a semi-conductive, endless belt-formed, second image carrier is disposed to the left side of photoreceptors 11Y, 11M, 11C and 11K, while being rotatably entrained about rollers 171, 172, 173 and 174. The intermediate transfer member 170 is driven in the direction indicated by the arrow through the roller 171 by a driving device (not shown in the drawing).

The yellow image forming section 10Y is provided with an electric-charging means 12Y, an exposure means 13Y, a developing means 14Y, a primary transfer roller 15Y as a primary transfer means and a cleaning means 16Y which are disposed around the photoreceptor 11Y.

The magenta image forming section 10M is provided with the photoreceptor 11M, an electric-charging means 12M, an exposure means 13M, a developing means 14M, a primary transfer roller 15M as a primary transfer means and a cleaning means 16M.

The cyan image forming section 10C is provided with the photoreceptor 11C, an electric-charging means 12C, an exposure means 13C, a developing means 14C, a primary transfer roller 15C as a primary transfer means and a cleaning means 16C.

The black image forming section 10K is provided with the photoreceptor 11K, an electric-charging means 12K, an exposure means 13K, a developing means 14K, a primary transfer roller 15K as a primary transfer means and a cleaning means 16K.

Toner supplying means 141Y, 141M, 141C and 141K supply toners to the developing means 14Y, 14M, 14C and 14K, respectively.

Primary transfer rollers 15Y, 15M, 15C and 15K each selectively operate according to the type of image by a control means not shown in the drawing and the intermediate transfer member 170 is compressed onto the respective photoreceptors 11Y, 11M, 11C and 11K to transfer an image onto the photoreceptor.

Thus, the respective color images formed on the photoreceptors 11Y, 11M, 11C and 11K in the image forming sections 10Y, 10M, 10C and 10K are sequentially transferred to the rotating intermediate transfer member 170 to form a combined color image.

Namely, a toner image held on the photoreceptor surface is primarily transferred onto the surface of an intermediate transfer member to hold the transferred toner image.

Recording paper P, as a recording medium which is contained within a paper feeding cassette 151, is fed by a paper feeding means and conveyed to a secondary transfer roller 117 as a secondary transfer means via plural intermediate rollers 122A, 122B, 122C, 122D and a resist roller 123. Then, a toner image which has been synthesized on an intermediate transfer member by the secondary transfer roller 117 is transferred together onto the recording paper P. Thus, the toner image held on the intermediate transfer member is secondarily transferred onto the surface of a material to be subjected to transfer.

A secondary transfer means 6 causes the recording paper P to be compressed to the intermediate transfer member 170 only when the recording paper P passes here and is subjected to secondary transfer.

The recording paper P onto which a color image is transferred is subjected to fixing by a fixing device 124, sandwiched between delivery rollers 125 to be eject onto a delivery tray 126 disposed outside the machine.

Meanwhile, after having transferred the color image onto the recording paper P by the secondary transfer roller 117, the intermediate transfer member 170 which has separated the recording paper P through self stripping is subjected to cleaning to remove a residual toner by a cleaning means 8.

Herein, the intermediate transfer member may be replaced by an intermediate transfer drum of a rotatable drum-form.

In the following, there will be described primary transfer rollers 15Y, 15M, 15C and 15K as a primary transfer means in contact with the intermediate transfer member 170, and the constitution of the intermediate transfer member 170.

The primary transfer rollers 15Y, 15M, 15C and 15K, or a secondary transfer roller 6 is formed by covering the circumferential surface of an electrically conductive core bar, e.g., stainless steel of 8 mm outer diameter with a 5 m thick semi-conductive elastic rubber exhibiting a rubber hardness of ca. 20-70° (Asker hardness C) and a volume resistance of ca. $1\times10^5$–$1\times10^9\Omega\cdot$cm in the form of a solid or a foamed sponge in which a conductive filler such as carbon is dispersed or an ionic conductive material is contained.

The secondary transfer roller 6 is formed by covering the circumferential surface of an electrically conductive core bar, e.g., stainless steel of 8 mm outer diameter with a 5 m thick semi-conductive elastic rubber exhibiting a rubber hardness of ca. 20-70° (Asker hardness C) and a volume resistance of ca. $1\times10^5$–$1\times10^5\Omega\cdot$cm in the form of a solid or a foamed sponge in which a conductive filler such as carbon is dispersed or an ionic conductive material is contained.

Transfer Material

A transfer material used in the present invention is a support holding a toner image, which is usually called an image support, a transfer material or a transfer paper. Specific examples thereof include plain paper of light and heavy paper, coated printing paper such as art paper and coated paper, commercially available Japanese paper or post card paper, plastic film used for OHP and fabric, but are not limited to these.

EXAMPLES

The present invention is further described specifically with reference to examples, but the present invention is by no means limited to these.

Preparation of Intermediate Transfer Member

An intermediate transfer member was prepared in the procedure, as described below.

Preparation of Resin Substrate

Resin Substrate 1:

There was prepared a 100 μm thick seamless belt comprised of polyimide (PI) containing an electrically conductive substance, which was denoted as resin substrate 1.

Resin Substrate 2:

There was prepared a 100 μm thick seamless belt comprised of poly(phenylene sulfide) (PPS) containing an electrically conductive substance, which was denoted as resin substrate 2.

Resin Substrate 3:

There was prepared a 100 μm thick seamless belt comprised of polyester containing an electrically conductive substance, which was denoted as resin substrate 3.

Resin Substrate 4:

There was prepared a 500 μm thick seamless belt comprised of chloroprene rubber (CR) and ethylene/propylene/diene rubber (EPDM) containing an electrically conductive substance, which was denoted as resin substrate 4.

Preparation of Intermediate Transfer Member 1:

Preparation of Elastic Layer:

A 150 μm thick "elastic layer 1" comprised of urethane rubber was provided by a dip-coating method on the outer circumference of the above-prepared resin substrate 1.

Preparation of Hard Layer

Subsequently, a hard layer was formed on the foregoing elastic layer 1 by using a plasma discharge apparatus, as shown in FIG. 1.

A material to form a hard layer employed silicon oxide. In the atmospheric plasma treatment apparatus, there was used a dielectric covering the individual electrode employed alumina which covered the single side at a 1 mm thickness by a ceramic thermal spray processing. After coverage, the spacing between electrodes was set to 1 mm. A dielectric-covered metal base material of the individual roll electrode was specifically for use in a stainless steel jacket having cooling function via water cycling, and a plasma treatment was performed, while controlling the electrode temperature during discharging by cooling water.

Layer-forming conditions are shown in Table 1. The individual raw material gas was heatedly vaporized and mixed/diluted with a discharge gas and a reactive gas which were previously heated to inhibit aggregation of raw materials, and then supplied to a discharge space.

Silicon Oxide Hard Layer Forming Condition:

Discharge gas: $N_2$ gas,

Reaction gas: 19 vol. % $O_2$ gas of total gas,

Raw material gas: 1.4 vol. % tetraethoxysilane (TEOS) of total gas,

Low-frequency power source [(High-frequency power source (50 k Hz), produced by Shinko Denki Co.): 10 W/cm$^2$, High-frequency power source [high-frequency power source, produced by PEARL KOGYO Co. (13.56 MHz)]: 5 W/cm$^2$.

Preparation of Intermediate Transfer Member 2:

Intermediate transfer member 2 was prepared similarly to the intermediate transfer member 1, provided that in preparation of a hard layer, the reaction gas was changed from $O_2$ (19 vol. %) to $H_2$ (4 vol. %) and the raw material gas was changed from tetraethoxysilane (1.4 vol. %) to aluminum s-butoxide (0.005 vol. %) and an intermediate layer was provided on the elastic layer.

Silicon Oxide Intermediate Layer Forming Condition:

Discharge gas: $N_2$ gas,

Reaction gas: 4 vol. % $H_2$ gas of total gas,

Raw material gas: 1.4 vol. % tetraethoxysilane (TEOS) of total gas,

Low-frequency power source [(High-frequency power source (50 k Hz), produced by Shinko Denki Co.): 10 W/cm$^2$, High-frequency power source [high-frequency power source, produced by PEARL KOGYO Co. (13.56 MHz)]: 5 W/cm$^2$.

Preparation of Intermediate Transfer Member 3:

Intermediate transfer member 3 was prepared similarly to the intermediate transfer member 1, provided that the discharge gas was changed from $N_2$ to Ar and the reaction gas and raw material gas changed from tetraethoxysilane (1.4 vol. %) to $CH_4$ (0.05 vol. %) without using reaction gas.

Preparation of Intermediate Transfer Member 4:

Intermediate transfer member 4 was prepared similarly to the intermediate transfer member 1, provided that the following coating solution containing fluorine was coated by dip coating to provide a low surface-energy layer (5 nm thick).

| Coating solution | |
|---|---|
| Coupling agent "OPTOOL DSX" (Produced by DAIKIN Co., Ltd.) | 1 mass part |
| Diluent "SOL-1" (produced by DAIKIN Co., Ltd.) | 100 mass parts |

Preparation of Intermediate Transfer Member 5:

Intermediate transfer member 5 was prepared similarly to the intermediate transfer member 1, provided that the elastic layer was changed from urethane rubber to chloroprene rubber, further thereon, the same hard layer as in the intermediate transfer member 1 was provided, and further thereon, a silicone-containing coating solution described below was coated by dip coating and dried at 50° C. for 1 hr. to provide a low surface-energy layer (10 nm thick).

| Coating solution | |
|---|---|
| Silicone resin (trade name: X-40-2269, Produced by Shin-Etsu Kagaku Co.) | 100 mass parts |
| n-Hexane | 400 mass parts |

Preparation of Intermediate Transfer Members 6-9:

Intermediate transfer members 6-9 were each prepared similarly to the intermediate transfer member 1, provided that a hard layer thickness was varied as shown in Table 1.

Preparation of Intermediate Transfer Member 10:

Intermediate transfer member 10 was prepared similarly to the intermediate transfer member 1, provided the same intermediate layer as in the intermediate transfer member 2 was provided on the elastic layer.

Preparation of Intermediate Transfer Member 11:

Intermediate transfer member 11 was prepared similarly to the intermediate transfer member 1, provided that the resin substrate 1 was changed to the resin substrate 2 and without forming an elastic layer, the thickness of a hard layer changed from 200 nm to 250 nm.

Preparation of Intermediate Transfer Member 12:

Intermediate transfer member 12 was prepared similarly to the intermediate transfer member 1, provided that the resin substrate 1 was changed to the resin substrate 3, urethane rubber of the elastic layer was changed to nitrile rubber (NBR) and the thickness of a hard layer was varied from 200 nm to 1000 nm.

Preparation of Intermediate Transfer Member 13:

Intermediate transfer member 13 was prepared in the manner that urethane elastomer raw materials are mixed with stirring in a mixer, molded into a mold arranging a metal belt and polished after being hardened at 90° C. over 6 hrs. Thus, there was prepared a seamless belt, intermediate transfer member 13 having a 0.3 cm thick semi-conductive elastomer on the outer circumference of the metal belt.

Preparation of Intermediate Transfer Member 14:

Intermediate transfer member 14 was prepared similarly to the intermediate transfer member 3, provided that the resin substrate 1 was changed to the resin substrate 4 and without forming an elastic layer, the thickness of a hard layer was changed from 100 nm to 1000 nm.

The foregoing intermediate transfer members are shown in Table 1, with respect to constitution of a substrate, elastic layer and surface layer (hard layer, low surface-energy layer) and their layer thicknesses, Young's modulus of the intermediate transfer member surface and an elastic layer, and Young's modulus difference (intermediate transfer surface/elastic layer).

TABLE 1

| Intermediate Transfer Member No. | Elastic Layer: Substrate: Substrate No. | ** | Elastic Layer: Material | ** | Intermediate Layer: Material | Production | ** | Surface Layer: Hard Layer: Material | Formation | ** |
|---|---|---|---|---|---|---|---|---|---|---|
| 1 | 1 | 100 | UR *1 | 150 | | | | $SiO_2$ | *4 | 200 |
| 2 | 1 | 100 | UR | 150 | $SiO_2$ | *4 | 0.3 | $Al_2O_3$ | *4 | 150 |
| 3 | 1 | 100 | UR | 150 | | | | DLC | *4 | 100 |
| 4 | 1 | 100 | UR | 150 | | | | $SiO_2$ | *4 | 200 |
| 5 | 1 | 100 | CR | 150 | | | | $SiO_2$ | *4 | 200 |
| 6 | 1 | 100 | DR | 150 | | | | $SiO_2$ | *4 | 10 |
| 7 | 1 | 100 | DR | 150 | | | | $SiO_2$ | *4 | 500 |
| 8 | 1 | 100 | UR | 150 | | | | $SiO_2$ | *4 | 600 |
| 9 | 1 | 100 | UR | 150 | | | | — | — | 0 |
| 10 | 1 | 100 | UR | 150 | $SiO_2$ | *4 | 1 | $SiO_2$ | *4 | 100 |
| 11 | 2 | 100 | — | — | — | — | — | $SiO_2$ | *4 | 250 |
| 12 | 3 | 100 | NBR | 800 | — | — | — | $SiO_2$ | *4 | 1000 |
| 13 | MB *2 | — | UE *3 | 300 | — | — | — | — | — | 0 |
| 14 | 4 | 500 | — | — | — | — | — | DLC | *4 | 1000 |

| Intermediate Transfer Member No. | Surface Layer Low Surface Energy Layer: Material | Layer Formation | ** | Young's Modulus: Elastic Layer (A) (GPa) | Intermediate Transfer member Surface (b) (GPa) | A-B (GPa) |
|---|---|---|---|---|---|---|
| 1 | — | — | — | 0.2 | 0.5 | 0.3 |
| 2 | — | — | — | 0.2 | 0.7 | 0.5 |
| 3 | — | — | — | 0.2 | 0.8 | 0.6 |
| 4 | Fluorine | Coating | 5 | 0.2 | 0.4 | 0.2 |
| 5 | Silicone | Coating | 10 | 0.3 | 0.5 | 0.2 |
| 6 | — | — | — | 0.2 | 0.2 | 0 |
| 7 | — | — | — | 0.2 | 2 | 1.8 |
| 8 | — | — | — | 0.2 | 2.5 | 2.3 |
| 9 | — | — | — | 0.2 | 0.2 | 0 |
| 10 | — | — | — | 6 | 6.5 | 0.5 |
| 11 | — | — | — | 9.3 | 18 | 8.7 |
| 12 | — | — | — | 0.3 | 3 | 2.7 |
| 13 | Fluorine | *4 | 30 | 0.5 | 0.6 | 0.1 |
| 14 | — | — | — | 0.4 | 5 | 4.6 |

$SiO_2$ = tetraethoxysilane, $Al_2O_3$ = tri-s-butoxyaluminum, DLC = Diamond-like carbon
*1 Urethane rubber,
*2 Metal belt,
*3 Urethane elastomer
** Thickness (μm),
*4 Plasma CVD Layer thickness and Young's modulus determined by the nanoindentation method are values determined by the method described earlier and by using the measurement apparatus described earlier.

Evaluation

Image Forming Apparatus

The foregoing prepared intermediate transfer members were each loaded to an image forming apparatus (magicolor 5440DL, produced by Konica Minolta Business Technologies Inc.) and evaluated.

A two-component developer composed of a toner exhibiting a volume-based median diameter ($D_{50}$) of 4.5 μm and a coated carrier of 60 μm ($D_{50}$) was used for image formation.

Printing was conducted under an environment of low temperature and low humidity (10° C., 20% RH) and high temperature and high humidity (33° C., 80% RH). A transfer material used high quality paper (64 g/m$^2$) of A4 size.

An original print document employed an original image composed of a text image with a pixel rate of 7% (3 point, 5 point, a portrait photograph, a solid white image and a solid black image, each accounting for ¼ equal part.

Evaluation

Primary Transfer Factor

Evaluation of primary transfer factor was made with respect to transfer factor at the initial time and after completion of printing of 160,000 sheets under low temperature and low humidity (10° C., 20% RH). When a solid image (20 mm×50 mm) exhibiting an image density of 1.30 was formed on a photoreceptor, a toner mass of a toner image formed on the photoreceptor and a toner mass of a toner remained on the photoreceptor after transferred to an intermediate transfer member were each measured, and a primary transfer factor was determined by the following equation:

Primary transfer factor (%)={[(toner mass of toner image formed on photoreceptor)−(toner mass of toner remained on photoreceptor)]/(toner mass of toner image formed on photoreceptor)}×100

A primary transfer factor of 95% or more was evaluated to be excellent.

Secondary Transfer Factor

Evaluation of secondary transfer factor was made with respect to transfer factor at the initial time and after completion of printing of 160,000 sheets under low temperature and low humidity (10° C., 20% RH). When a solid image (20 mm×50 mm) exhibiting an image density of 1.30 was formed on a photoreceptor, a mass of a toner transferred onto a transfer material and a toner mass of a toner image formed on an intermediate transfer member were each measured and a secondary transfer factor was determined by the following equation:

Secondary transfer factor (%)=[(mass of toner transferred onto transfer material)/(toner mass of toner image formed on intermediate transfer member)]×100

A secondary transfer factor of 95% or more was evaluated to be excellent.

Lack of Text Image

Evaluation regarding lack of text image was conducted in the following manner. When printing was conducted under high temperature and high humidity (33° C., 80% RH), 10 sheets at the initial stage and 10 sheets after completion of printing of 160,000 sheets were taken out, and text images were observed by a magnifier to evaluate an extent of occurrence of lack of text image and evaluated based on the following criteria:

A: number of lacks of text image being 3 or less in printed images of all of 10 sheets and being excellent, B: number of lacks of text image being 4 or more and 19 or less in printed images of at least one sheet but being acceptable in practical use, C: number of lacks of text image being 20 or more in printed images of at least one sheet and being unacceptable in practical use.

Filming on Intermediate Transfer Member

An intermediate transfer member was taken out after completion of printing of 10,000 sheets and filming on the intermediate transfer member was evaluated a filming state on the surface of the intermediate transfer member was visually observing to evaluate filming on the intermediate transfer member, based on the following criteria:

A: no filming being observed on an intermediate transfer member,

B: slightly filming being observed on an intermediate transfer member but acceptable in practice, C: filming being observed on the circumference of an intermediate transfer member and unacceptable in practice.

Blade Cleaning Capability

After performing printing under an environment of low temperature and low humidity (10° C., 20% RH), the surface of an intermediate transfer member which had been cleaned by blade-cleaning was visually observed to evaluate blade-cleaning capability with respect to an extent of a toner remained on the surface and staining of printed images, due to cleaning trouble.

Further, occurrence of burr in blade cleaning was also evaluated to be cleaning trouble.

Criteria for Evaluation:

A: No uncleaned residual toner being observed until printing 160,000 sheets and no staining due to printing trouble being observed in print images, B: Slightly uncleaned residual toner being observed when printing 160,000 sheets but no staining due to printing trouble being observed in print images, C: Uncleaned residual toner being observed when printing 100,000 sheets and image staining due to cleaning trouble being observed in print images and unacceptable in practice.

TABLE 2

| Intermediate Transfer Member No. | Primary Transfer Factor (%) | Secondary Transfer Factor (%) Initial Time | Secondary Transfer Factor (%) After Printing of 160,000 sheets | Lack of Text Image | Blade Cleaning Capability | Filming | Remark |
|---|---|---|---|---|---|---|---|
| 1 | 96 | 98 | 95 | A | A | B | Inv. |
| 2 | 95 | 97 | 95 | A | A | A | Inv. |
| 3 | 95 | 98 | 95 | A | A | B | Inv. |
| 4 | 96 | 99 | 97 | A | A | B | Inv. |
| 5 | 96 | 99 | 96 | A | A | B | Inv. |
| 6 | 97 | 98 | 96 | A | B | B | Inv. |
| 7 | 95 | 97 | 95 | A | A | B | Inv. |
| 8 | 92 | 96 | 94 | B | A | C | Comp. |
| 9 | 97 | 90 | 87 | A | C | C | Comp. |
| 10 | 94 | 98 | 95 | B | A | B | Comp. |
| 11 | 87 | 94 | 92 | C | A | B | Comp. |
| 12 | 89 | 95 | 93 | B | A | C | Comp. |
| 13 | 97 | 97 | 94 | A | C | C | Comp. |
| 14 | 88 | 96 | 93 | C | A | C | Comp. |

As apparent from Table 2, it was proved that Intermediate transfer members 1-7 of the present invention have achieved superior results in the respective evaluations of secondary transfer factor, lack of text Image, blade cleaning property and durability (filming); on the contrary, Intermediate transfer members 8-14 (Comparison) produced problems in any one of evaluation items.

What is claimed is:

1. An intermediate transfer member for use in an image forming apparatus having a device capable of transferring a toner image carried on a surface of an electrophotographic photoreceptor primarily to the intermediate transfer member, and secondarily transferring the toner image from the intermediate transfer member to a transfer material, wherein the intermediate transfer member is provided with an elastic layer on a circumference of a resin substrate and further thereon a surface layer, the surface layer exhibits a layer thickness of 10 to 500 nm, a Young's modulus of a surface of the intermediate transfer member which is determined by a nanoindentation method is 0.1 to 5.0 GPa and is 0.0 to 2.0 GPa greater than a Young's modulus of the elastic layer which is determined by a nanoindentation method.

2. The intermediate transfer member as claimed in claim 1, wherein the Young's modulus of the surface of the intermediate transfer member which is determined by a nanoindentation method is 0.1 to 2.0 GPa and is 0.0 to 2.0 GPa greater than a Young's modulus of the elastic layer which is determined by a nanoindentation method.

3. The intermediate transfer member as claimed in claim 1, wherein the Young's modulus of the surface of the intermediate transfer member which is determined by a nanoindentation method is 0.1 to 1.0 GPa and is 0.0 to 1.0 GPa greater than a Young's modulus of the elastic layer which is determined by a nanoindentation method.

4. The intermediate transfer member as claimed in claim 1, wherein the surface layer exhibits a layer thickness of 30 to 300 nm.

5. The intermediate transfer member as claimed in claim 1, wherein the surface layer comprises at least one hard layer, or at least one hard layer and at least one low surface-energy layer.

6. The intermediate transfer member as claimed in claim 5, wherein the hard layer is a layer formed of at least one of a metal oxide, a silicon compound and a carbon film.

7. The intermediate transfer member as claimed in claim 5, wherein the low surface-energy layer is a layer containing fluorine or silicon.

8. The intermediate transfer member as claimed in claim 1, wherein the elastic layer comprises at least one elastic layer, or at least one elastic layer and at least one intermediate layer.

9. The intermediate transfer member as claimed in claim 8, wherein the intermediate layer is formed of at least one of a metal oxide, a silicon compound and a carbon membrane.

10. The intermediate transfer member as claimed in claim 1, wherein a Young's modulus of the elastic layer which is determined by a nanoindentation method is 0.1 to 2.0 GPa.

11. The intermediate transfer member as claimed in claim 1, wherein a Young's modulus of the elastic layer which is determined by a nanoindentation method is 0.1 to 1.0 GPa.

12. The intermediate transfer member as claimed in claim 1, wherein the elastic layer is a layer formed of at least one of a chloroprene rubber, a nitrile rubber, a styrene-butadiene rubber, a silicone rubber, a urethane rubber and an ethylene-propylene copolymer.

13. The intermediate transfer member as claimed in claim 1, wherein a Young's modulus of the resin substrate which is determined by a nanoindentation method is 5.0 to 15 GPa.

14. The intermediate transfer member as claimed in claim 1, wherein the resin substrate is formed of at least one of a polyimide, a polycarbonate and a poly(phenylene sulfide).

* * * * *